US008739595B2

(12) United States Patent
Hafner et al.

(10) Patent No.: US 8,739,595 B2
(45) Date of Patent: Jun. 3, 2014

(54) PUNCHING PRESS

(75) Inventors: Josef Thomas Hafner, Rorschacherberg (CH); Ugo De Santis, Roggwil (CH)

(73) Assignee: Bruderer AG, Frasnacht (CH)

( * ) Notice: Subject to any disclaimer, the term of this patent is extended or adjusted under 35 U.S.C. 154(b) by 1191 days.

(21) Appl. No.: 12/663,534

(22) PCT Filed: Jun. 26, 2008

(86) PCT No.: PCT/CH2008/000291
§ 371 (c)(1),
(2), (4) Date: Apr. 21, 2010

(87) PCT Pub. No.: WO2009/000100
PCT Pub. Date: Dec. 31, 2008

(65) Prior Publication Data

US 2010/0206187 A1 Aug. 19, 2010

(30) Foreign Application Priority Data

Jun. 28, 2007 (EP) ..... 07012661

(51) Int. Cl.
*B21D 13/00* (2006.01)
*B21J 9/18* (2006.01)

(52) U.S. Cl.
USPC ..... 72/446; 72/452.5

(58) Field of Classification Search
USPC ..... 72/446, 450, 451, 452.5; 100/269.11, 100/269.13, 280, 282
See application file for complete search history.

(56) References Cited

U.S. PATENT DOCUMENTS 2,120,356 A * 6/1938 Glasner ..... 72/345
2,375,398 A 5/1945 Wilkins (Continued)

FOREIGN PATENT DOCUMENTS

CH 541 418 9/1973
CH 568 848 11/1975

(Continued)

OTHER PUBLICATIONS

Drawing OM4611005 (vertical section of Bruderer Press BSTA 60), available for consideration by the inventors before Jun. 28, 2007.

(Continued)

*Primary Examiner* — Teresa M Ekiert
(74) *Attorney, Agent, or Firm* — McCormick, Paulding & Huber LLP

(57) ABSTRACT

The invention relates to a punching press with a clamping plate (27) and with a press ram (1) which lies opposite the upper side of the clamping plate (27) and operates towards the clamping plate (27) and is moveable up and down via four tension columns (2) by means of a crank drive arranged below the belt movement plane (X) of the punching press. The press ram (1) is guided exclusively via the tension columns (2) which, in turn, are guided in inclination-tolerant guides (3) in the belt movement plane (X) in such a manner that the press ram (1) and the tension columns (2) can be positioned obliquely as a consequence of differing longitudinal expansion of the tension columns (2) under an eccentric load by the tension columns (2) being inclined about axes of inclination running in the region of the belt movement plane (X) of the punching press. By means of the configuration according to the invention, distortion of the punching press under an eccentric load, which would lead to uncontrollable operating conditions during the punching and a high degree of wear at the guides of the machine, is avoided, and it can be ensured that, in the event of a possible skewed position of the ram, no tool offset, which would result in a high degree of tool wear or even in tool fracture, occurs.

33 Claims, 8 Drawing Sheets

(56) References Cited

U.S. PATENT DOCUMENTS

| | | | | | |
|---|---|---|---|---|---|
| 2,544,540 | A | | 3/1951 | Maussnest | |
| 2,696,165 | A | * | 12/1954 | Hecht | 100/282 |
| 3,422,688 | A | | 1/1969 | Bruderer | |
| 3,998,498 | A | | 12/1976 | Portmann | |
| 4,160,409 | A | | 7/1979 | Portmann | |
| 4,238,950 | A | * | 12/1980 | Carrieri et al. | 72/446 |
| 4,607,518 | A | | 8/1986 | Schubert et al. | |
| 4,987,794 | A | | 1/1991 | Brunner et al. | |
| 5,317,893 | A | | 6/1994 | Eigenmann et al. | |
| 5,458,057 | A | * | 10/1995 | Arens | 72/446 |
| 5,746,123 | A | | 5/1998 | Eigenmann | |
| 5,823,087 | A | | 10/1998 | Eigenmann | |
| 5,852,970 | A | | 12/1998 | Bornhorst et al. | |
| 6,055,903 | A | | 5/2000 | Eigenmann | |
| 6,170,392 | B1 | | 1/2001 | Watercutter et al. | |
| 6,247,399 | B1 | * | 6/2001 | Yoshida | 100/282 |
| 6,477,945 | B1 | | 11/2002 | Imanishi et al. | |
| 2001/0002566 | A1 | | 6/2001 | Eigenmann | |

FOREIGN PATENT DOCUMENTS

| | | | |
|---|---|---|---|
| CH | 581 281 | | 9/1976 |
| CH | 427 442 | | 12/1996 |
| DE | 1 301 670 | | 8/1969 |
| DE | 25 34 626 | | 11/1976 |
| EP | 0 074 716 | A2 | 3/1983 |
| EP | 0 165 518 | | 12/1985 |
| EP | 0 165 518 | A2 | 12/1985 |
| EP | 0 356 809 | A1 | 3/1990 |
| EP | 0 360 875 | | 4/1990 |
| EP | 0 360 875 | A1 | 4/1990 |
| EP | 0 546 265 | A1 | 9/1992 |
| EP | 0 724 953 | | 8/1996 |
| EP | 0 724 953 | A1 | 8/1996 |
| EP | 0 765 735 | | 4/1997 |
| EP | 0 765 735 | A1 | 4/1997 |
| EP | 0 927 630 | A1 | 7/1999 |
| EP | 0 953 438 | A1 | 11/1999 |
| GB | 889479 | | 2/1962 |
| JP | 63-25389 | | 7/1978 |
| JP | 58-119494 | A | 7/1983 |
| JP | 61-14038 | A | 1/1986 |
| JP | 62-009728 | A | 1/1987 |
| JP | 7-164198 | A | 6/1995 |
| JP | 8-267294 | A | 10/1996 |
| WO | 99/58265 | | 11/1999 |

OTHER PUBLICATIONS

Drawing OM4027 (horizontal section of Bruderer Press BSTA 60), available for consideration by the inventors before Jun. 28, 2007.

Drawing with vertical section of a press from a brochure of the company Muller Stanz-+Umformtechnik GmbH+Co. KG, available for consideration by the inventors before Jun. 28, 2007.

p. 12/12 of an internal document showing a flyer concerning a press called "synchropress", available for consideration by the inventors before Jun. 28, 2007.

* cited by examiner

PUNCHING PRESS

REFERENCE TO RELATED APPLICATIONS

This application claims the priority of the European Patent Application No. 07 012 661.0, which has been filed on Jun. 28, 2007 and the disclosure of which in its entirety is incorporated in this application by reference.

1. Technical Field

The present invention relates to a punching press.

2. Background Art

In the industrial manufacturing of sophisticated punching parts punching presses with a drive mechanism that is arranged below the punching plane and is connected with the press ram via tension columns have proven particularly well suited, since with such punching presses, in particular in embodiments in which the press ram is connected at each of its four outer corners with a tension column, an as high as possible resistance against tilting in the direction of the material flow as well as in the direction transverse thereto can be achieved. As an example for such a press the automatic punching press of Type BSTA 60 of the company Bruderer AG, CH-Frasnacht, is to be mentioned, of which since 1965 more than 1100 units have been produced. In this punching press, two of the four tension columns in each case are driven via a common crank drive, which is accomplished in that the end of the connecting rod of the crank drive which is remote to the crankshaft is directly hinged to a yoke which fixedly connects the two tension columns.

In the light of the continuously increasing requirements with regard to the flexibility of production, punching frequency and punching precision, this machine concept today is no longer able to fully cope with all requirements, the more so as a further increase in the maximal punching frequency or an operation with a pronounced eccentric load of the ram is opposed by a disproportionate increasing load of the components and, coming along therewith, a corresponding wear and tear and a corresponding increasing need for maintenance, respectively, results.

DISCLOSURE OF THE INVENTION

Hence, it is a general object to provide a punching press which does not show the disadvantages of the prior art or at least partially avoids them.

This object is achieved by the punching press according to the invention.

Accordingly, the invention concerns a punching press with a stationary clamping plate and with a press ram which is lying opposite to the upper side of the clamping plate and is operating towards the clamping plate. For the operation of the punching press, the stationary part of a punching tool to be operated with the punching press is carried by the upper side of the clamping plate, while the moving part of the tool is carried by the press ram. The press ram is drivable with a drive mechanism arranged below the punching plane via tension columns, which serve for the transmission of the driving forces to the press ram, in such a manner that it performs the upward and downward movement needed for the punching operation. The guidance of the press ram is accomplished exclusively via the tension columns which preferably are fixedly connected with the press ram, which tension columns are in vertically displaceable manner guided in guides in the structure of the punching press. The guides are designed in such a manner that an inclination of the press ram and of the tension columns caused by an eccentric loading of the ram can take place through an inclination of the tension columns about axes of inclination running in the region of the band movement plane. As "region of the band movement plane", a range of between 40 mm above and 40 mm below the ideal or medial band movement plane, respectively, is understood here. For example, this can be achieved through use of a single inclination-tolerant guide per tension column, the axes of inclination of which run in the region of the band movement plane, or through use of two guides per tension column which are arranged at a distance to each other and which are received in the structure of the press in such a manner that they can jointly incline about axes of inclination which run in the region of the band movement plane.

By means of the configuration according to the invention, a distortion of the punching press under an eccentric load, which would lead to uncontrollable operating conditions and increased wear and tear, is avoided. A significant bending load of the tension columns is in this construction only possible in case the interconnection between the press ram and the tension column is realized in a flexurally rigid manner and is furthermore limited to the transition point between the tension column and the press ram where this bending load is unproblematic. Furthermore, through the configuration according to the invention it is ensured that, in the event of an inclination of the ram, no tool offset, which would result in a high degree of tool wear or even in tool fracture, occurs. Accordingly, through the invention it becomes possible to provide punching presses which combine a minimum of wear and tear, at the machine side as well as at the tool side, with a maximum of punching precision also at eccentric load.

In a preferred embodiment of the punching press, the tension columns are guided exclusively in the region of the band movement plane of the punching press, preferably in the ideal or medial band movement plane of the punching press, namely preferably in inclination-tolerant guides, which furthermore preferably are substantially moment-free. As inclination-tolerant guides are understood here guides which by their design permit an inclination of the tension column with respect to the neutral guiding axis, which usually is the vertical axis, by at least 0.05°, preferably by at least 0.10°, without any damage or increased wear and tear. As being substantially moment-free such bearings are considered here in case they do not oppose the inclination with significant forces. Through this embodiment, the structural effort for realizing the guidance of the ram can be reduced to a minimum and the use of extremely short tension columns becomes possible, which in view of an undesirable longitudinal expansion of same under load is advantageous.

In a further preferred embodiment of the punching press, two tension columns which are arranged opposite to each other in each case are fixedly connected with each other via a connecting element, like for example via a yoke. By this, the advantage is arrived at that the force components of two tension columns can be merged and skewed force components can be compensated by the yoke. For driving the two columns, for example a central crank drive is sufficient. The connection is by advantage established in the region of the ends of the tension columns which are facing away from the press ram. Depending on the design of the tension column guides and the connection between the tension columns and the drive mechanism it is also possible to established the mentioned connection in a region between the two ends of the respective tension columns. This embodiment is particularly advantageous if also the connection between the press ram and the tension columns is rigid, so that the press ram, the tension columns and the connecting element form, in the plane defined by the longitudinal axes of the tension columns, a frame structure which is substantially rigid with regard to its angles and can perform an inclination movement as a whole.

In still a further preferred embodiment, the punching press comprises exactly four tension columns, which are in each case arranged at the corners of the press ram. By means of this, a maximum resistance against tilting of the ram in longitudinal direction as well as transverse thereto can be achieved.

In that case it is, in embodiments of the punching press in which two tension columns which are lying opposite to each others are in each case rigidly connected via a connecting element, preferred that the tension columns, which in direction transverse to the direction of the band flow of the press are lying opposite to each others, in each case at their lower ends are interconnected via a transverse yoke. By means of this, the advantage is arrived at that a modular press design becomes possible. Through combination of identical drive units and guide units with rams and clamping plates of different lengths punching presses of different overall lengths can be configured from only a few different components.

In still a further preferred embodiment, the drive mechanism of the punching press comprises means for the compensation of a longitudinal expansion of the tension columns as a consequence of load, namely preferably for the individual compensation of a longitudinal expansion as a consequence of load of each individual tension column, so that a correction of different longitudinal expansions of the tension columns, which occur in operation under eccentric load, and of the inclination of the press ram resulting therefrom, becomes possible. Due to the configuration according to the invention of the press it is e.g. also possible to adjust the punching press for operation with eccentric load in such a manner that without load the press ram is inclined but under load is aligned.

In still a further preferred embodiment of the punching press, the drive mechanism comprises at least one crankshaft with one or several connecting rods arranged on one or several crank pins of the crankshaft, by means of which a rotatory driving movement provided by a drive motor can be converted into an intermittent upward and downward movement for driving at least one tension column of the press ram. Depending on the design, the crankshaft can thus serve for driving only one tension column, for driving several tension columns or for driving all tension columns of the punching press. Such drive concepts are well proven in the field of punching presses and typically show an advantageous punching force path. Furthermore, due to the harmonic courses of motion, a long life time of the highly loaded components results.

In this case it is preferred that the at least one crankshaft runs in longitudinal direction of the punching press, thus in direction of flow of the band, wherein it is further preferred that exactly one crankshaft running in longitudinal direction is present for driving all tension columns. By means of this, a punching press according to the invention can be realized in a simple and cost effective manner in which all tension columns are necessarily synchronized.

In this case it is furthermore preferred that the exactly one crankshaft is arranged centrally along the longitudinal axis of the punching press in such a manner that a symmetrical arrangement with respect to the tension columns results. By means of this, the advantage of a symmetrical force distribution in the whole press arrangement is arrived at, through which from the drive side optimal conditions for a maximal parallelism of clamping plate and ram under load can be ensured.

In the previous mentioned embodiment with exactly one crankshaft it is furthermore preferred that the crankshaft comprises exactly two crank pins, which are arranged preferably in each case in the region of an end of the crankshaft and, at least on the side facing away from the respective shaft end, are flanked by a radial bearing of the crankshaft dedicated to this crank pin, which radial bearing preferably is a roller bearing. Such a configuration has the advantage that it becomes possible to arrange the crank pins at the longitudinal position of the tension columns, so that any bending moments in the press structure generated by bearing forces can be avoided.

In that case it is furthermore advantageous that the crank pins in each case from both sides are flanked by a radial bearing of the crankshaft dedicated to the respective crank pin, which radial bearing preferably is a roller bearing, so that also an introduction of bending moments into the crankshaft is substantially avoided.

Furthermore it is preferred in the two before mentioned embodiments of the punching press that the crankshaft in the region between the radial bearings, which in each case are arranged on the side of the respective crank pin which is facing away from the shaft end, is designed as hollow shaft. By means of this, the rotatory moment of inertia of the crankshaft can be kept relative small, with an at the same time sound rotatory stiffness of same.

Also it is preferred in that case that the crankshaft is designed as a composed shaft, i.e. is designed as an assembled shaft, namely in such a manner that the part which is designed as hollow shaft is a component which is separate from the crank pins. By means of this, a separate manufacturing of smaller components becomes possible and diverse types of crankshafts can be assembled from only a few components (modularity), so that the costs for manufacturing and stockkeeping can be reduced.

Furthermore it is, in embodiments of the punching press the drive mechanism of which comprises at least one crankshaft with one or several connecting rods, preferred that the crankshaft is designed in such a manner that the stroke of its crank pins is adjustable. In this case it is furthermore preferred that the crankshaft comprises crank pins which are formed in each case by an eccentric and an eccentric bushing which is rotatable on the eccentric in such a manner that, by rotating the eccentric bushing on the eccentric, diverse strokes of the crankshaft can be adjusted. By means of this, the advantage of an adjustability of the stroke is arrived at.

If in that case the eccentrics and the eccentric bushings of the respective crank pins are lockable in certain positions with respect to each other by locking means, preferable by locking bolts, for the definition of a specific stroke of the crankshaft, an adjustment to specific, exactly defined stroke values becomes possible in a simple way.

If, in the before mentioned embodiment, the crankshaft in the region between those radial bearings, which in each case are arranged at the side of the respective crank pin which is facing away from the shaft end, is designed as a hollow shaft, which is preferred, it is furthermore preferred that the locking means are unlockable via a central unlocking mechanism, which extends through the interior space of the part of the crankshaft that is designed as hollow shaft. This configuration makes possible a simple design with an, at the same time, easy way of unlocking and, combined therewith, with an easy convertability of the machine to other strokes.

In still a further preferred embodiment of the punching press having a drive mechanism which comprises at least one crankshaft with one or several dedicated connecting rods, the crankshaft is supported in radial bearings, wherein exactly one of the radial bearings is designed as a fixed bearing, for receiving the axial forces acting upon the crankshaft. By means of this, the advantage results that the crankshaft has a defined thrust bearing, in contrast to the otherwise common floating arrangement of bearings.

In still a further preferred embodiment of the punching press having a drive mechanism which comprises at least one crankshaft with one or several dedicated connecting rods, the crankshaft is supported in radial bearings, which in each case are dedicated to one of the crank pins and per crank pin are supported in a separate housing part, which housing part in each case is connected, preferably by screwing, with a central housing part that carries or forms the clamping plate. By means of this, the basic structure of the punching press can be built from several small, modular components, which makes possible savings in the costs for stock-keeping and manufacturing.

In a first alternative embodiment of the punching press having a drive mechanism which comprises at least one crankshaft with one or several dedicated connecting rods, in each case the end of the connecting rod which is remote to the crankshaft is hinged to a first end of a lever or at respective first ends of several levers, which levers at their second ends are directly or indirectly hinged to the structure of the punching press, e.g. by means of a suspension bolt that is supported in an immobile manner at the housing of the punching press (directly), or e.g. via a support arrangement which is fastened to the housing of the punching press having a pivot point for the lever and/or via a lug (indirectly). In this case the linkage is such that the lever or the levers can be tilted back and forth around their second end by means of the connecting rod through rotating the crankshaft. Furthermore, the lever or levers are in each case in a region between the first and the second end hinged to at least one tension column of the punching press in such a manner that the tension column can be moved upward and downward by moving back and forth the respective lever. This configuration of the punching press results in the advantage that the ram driving forces are split, by means of which the bearing load of the crankshaft is significantly reduced, which in turn favors a high service life of the press (little wear and tear) and a high precision even at high punching frequencies. Due to the gear reduction of the stroke movement generated by the crank drive within the lever arrangement of the press, this embodiment is especially suited as "short stroke press".

At such punching presses it is preferred that the respective lever at its second end via a lug is indirectly hinged to the structure of the punching press. By means of this, there is the advantage that substantially only vertical forces can be transferred via this pivoting point to the structure, so that a bending load of the components forming the pivoting point is substantially avoided. This is particularly advantageous in case the pivoting point is formed by an adjustable supporting arrangement, e.g. by a threaded spindle, by means of which the vertical position of the pivoting point is adjustable.

Also it is preferred in this case that the respective lever in a region between the first and the second end via a lug is connected with the tension column. By means of this, a horizontal mobility results with the additional advantage that substantially only vertical forces can be transferred via this pivoting point.

Also it is preferred in this embodiment of the punching press that in each case a guide is present by means of which the end of the respective connecting rod which is remote to the crankshaft is vertically guided in such a manner that its pivoting point for the lever or the levers is movable exclusively in vertical direction. Through this a horizontal fixation of this pivoting point results, which simplifies the linkage of two levers that are lying opposite to each other in mirror-inverted manner with a common connecting rod.

Accordingly, it is in that case preferred that the end of the respective connecting rod which is remote from the crankshaft forms a common pivoting point with the first ends of two levers that, seen in longitudinal direction of the crankshaft, are arranged opposite to each other in a mirror-inversed manner, which preferably, seen in longitudinal direction of the crankshaft, in each case are dedicated in mirror-inversed manner to a tension column. Through this there is the advantage of a compact design and of a necessarily synchronous drive of two tension columns.

In a second alternative preferred embodiment of the punching press having a drive mechanism which comprises at least one crankshaft with one or several dedicated connecting rods, the end of each connecting rod which is remote to the crankshaft in each case is connected with a first end of at least one lever, which in a region between its first and second end is hinged to the structure of the punching press, e.g. by means of a suspension bolt that is supported in an immobile manner at the housing of the punching press (directly), or e.g. via a support arrangement which is fastened to the housing of the punching press having a pivot point for the lever and/or via a lug (indirectly). In this case the linkage is such that the lever can be tilted back and forth around its pivoting point through the connecting rod by rotating the crankshaft, wherein the lever at its second end is hinged to at least one tension column of the punching press in such a manner that the tension column can be moved upward and downward by moving back and forth the lever. From this configuration of the punching press the advantage results that through the reversal of the movements via the levers, due to characteristics of the system already a certain compensation of the masses in motion takes place, so that only little additional compensation masses are required. Also, a transmission ratio of the crank stroke to the ram stroke of 1:1 or bigger can be realized here in a simple way, so that this embodiment is especially suited as "long stroke press".

In this case it is preferred that the respective lever in a region between its first and its second end, preferably by means of a bolt forming a swivelling axis, is directly hinged to the structure of the punching press, so that vertical as well as horizontal forces can be transferred via this pivoting point to the structure.

Also it is preferred in this case that the respective lever at its second end is connected via a lug with the tension column. By means of this, the advantage is arrived at that substantially only vertical forces can be transferred via this pivoting point.

Furthermore, it is preferred in this embodiment of the punching press that a guide is present in each case by means of which the end of the connecting rod, which is remote from the crankshaft, is vertically guided in such a manner that this end is exclusively movable in vertical direction. The end of the connecting rod which end is remote from the crankshaft and in this way is made immobile in horizontal direction, is via a lug connected with the first end of the at least one lever. Through this, the linkage of two levers, which are lying opposite to each other in a mirror-inversed manner and are horizontally immobile, to a common connecting rod becomes possible.

Accordingly, it is preferred that the end of the respective connecting rod which is remote to the crankshaft is hinged, via separate lugs, to the first ends of two levers which are opposite to each other, are immobile in horizontal direction and, seen in longitudinal direction of the cranks shaft, are arranged in an mirror-inverted manner, which preferably, seen in longitudinal direction of the crankshaft, are dedicated in an mirror-inverted manner in each case to a tension column.

By means of this, the advantage of a compact design and of a necessarily synchronous driving of two tension columns is arrived at.

Thereby it is, in variants of the two before mentioned alternative preferred embodiments of the punching press in which the end of the respective connecting rod which is remote to the crankshaft is hinged to two levers which are opposite to each other and are, seen in longitudinal direction of the cranks shaft, arranged in an mirror-inverted manner, preferred that the tension columns, to which the levers which are opposite to each other in an mirror-inverted manner are dedicated, in the region below their guides are in a rigid manner connected with each other, in particular via a yoke. By this, a stabilization of the tension columns among each other results and an advantageous introduction of the driving forces into the tension columns via the yoke becomes possible.

Furthermore it is, in variants of the two before mentioned alternative preferred embodiments of the punching press which comprise means for the compensation of a longitudinal expansion of the tension columns as a consequence of load, preferred that the means for compensation of a longitudinal expansion of the tension columns as a consequence of load are designed in such a manner that by means of them the position and preferably the vertical position of the pivoting point of the respective lever at the structure of the punching press is adjustable, namely preferably during operation of the press. By this the advantage is arrived at that an adjustment of the position of the ram becomes possible, namely by advantage also during punching operation.

For doing so, in this case the position of the pivoting point of the respective lever at the structure of the punching press preferably is adjustable by means of a threaded spindle, namely preferably with the aid of an actuator driving the threaded spindle.

Alternatively, it is also preferred that the position of the pivoting point of the respective lever at the structure of the punching press is adjustable by means of an eccentric, which can be turned by means of an actuator which preferably comprises a planetary gear.

Such solutions are well proven, cost effective and safe, and furthermore allow for an automated setting/adjusting of the pivoting point via a control system.

Furthermore it is, in variants of the two before mentioned alternative preferred embodiments of the punching press which comprise means for the compensation of a longitudinal expansion of the tension columns as a consequence of load and in which several levers for the upward and downward movement of the tension columns are present, wherein each lever is dedicated to exactly one tension column, preferred that the vertical position of the pivoting points of the levers can be adjusted in groups or independently of each other. Thus, such preferred embodiments of the punching press comprise several levers according to the claims, the first ends of which in each case are hinged to or connected with the end of a connecting rod which end is remote from the crankshaft, wherein the levers directly or indirectly are hinged to the structure of the punching press in such a manner that the respective lever by rotating the crankshaft through the connecting rod can be tilted back and forth around its pivoting point. In this case, the levers in each case are, as the case may be, by being hinged to a yoke which connects two tension columns hinged to a tension column of the punching press dedicated to the respective lever in such a manner that the tension column, through swivelling back and forth of the lever, can be moved upward and downward. Thereby, the punching press is designed in such a manner that the vertical positions of the pivoting points of the levers can be adjusted in groups or independently of each other. In particular for punching presses with four tension columns, which in each case are arranged in the region of the outer corners of the press ram, by doing so the possibility of an optimal compensation of unequal deformations of components due to eccentric load (e.g. longitudinal expansion of the tension columns) during punching operation arises, since the ram can be kept parallel to the clamping plate under load through a purposeful different adjusting of the positions of the pivoting points of the levers.

BRIEF DESCRIPTION OF THE DRAWINGS

Further preferred embodiments of the invention arise from the dependent claims and from the now following description by means of the drawings. Therein show:

MODES FOR CARRYING OUT THE INVENTION

Figure 1:
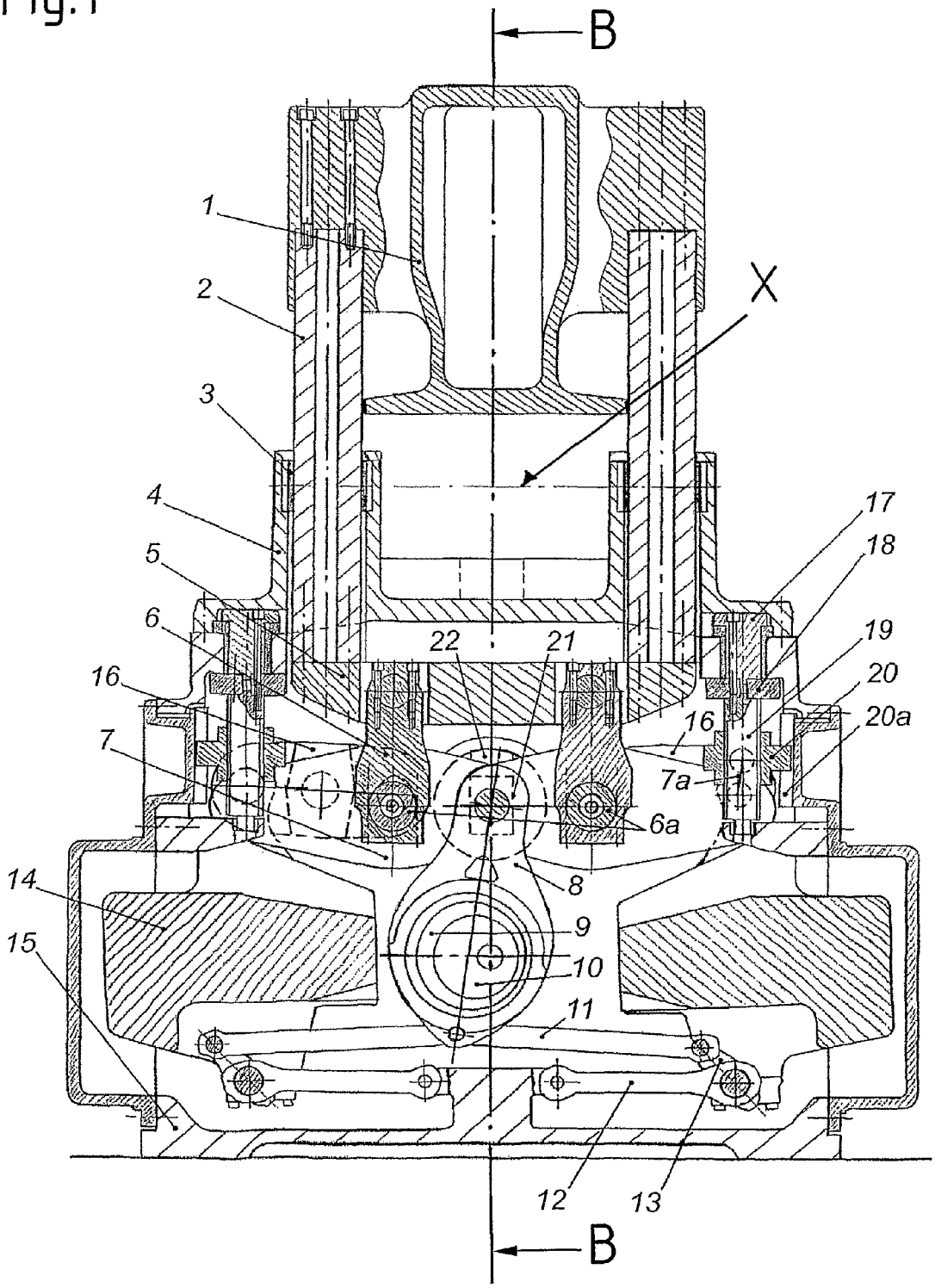
FIG. 1 a cross section through a first punching press according to the invention along line A-A in FIG. 2.
Figure 2:
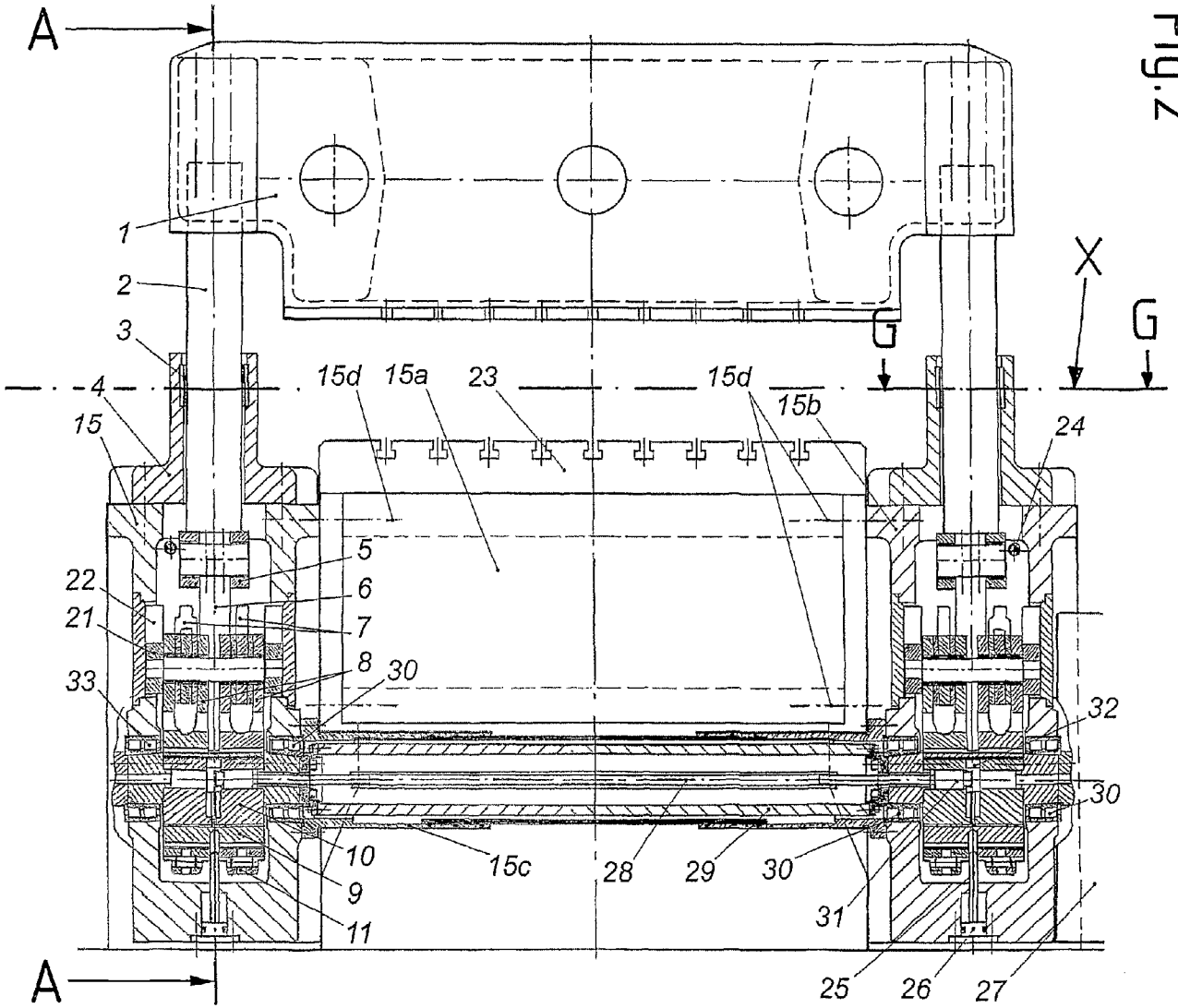
FIG. 2 a longitudinal section along line B-B in FIG. 1.
Figure 3:
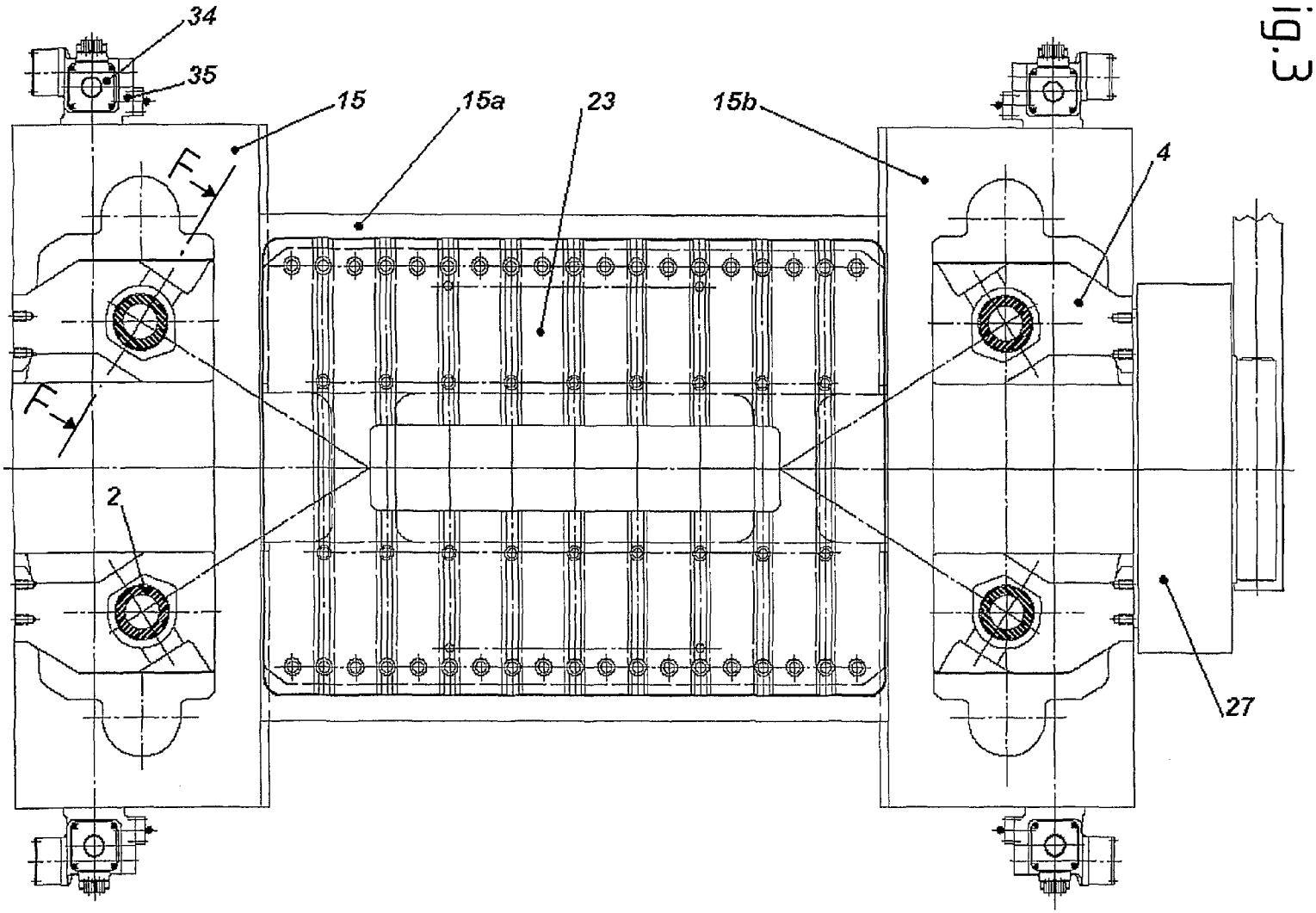
FIG. 3 a top view onto the punching press of the FIGS. 1 and 2 with the press ram removed.

The basic configuration of a first punching press according to the invention is evident from the FIGS. 1 to 4, which show a cross section (FIG. 1), a longitudinal section (FIG. 2) and horizontal sections through one of the machine housings (FIG. 4) of the punching press, as well as a top view onto the punching press with the press ram removed (FIG. 3).

Figure 5A:
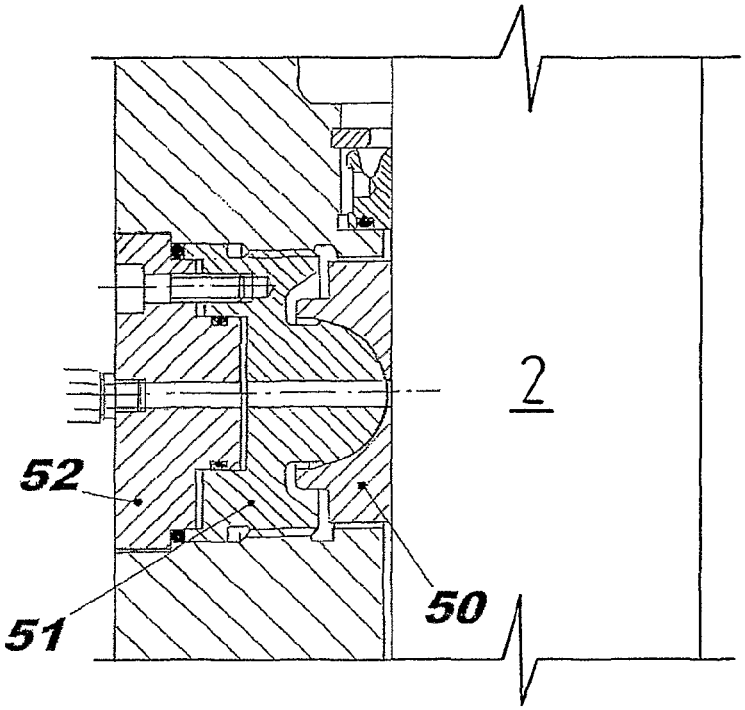
FIG. 5*a* a vertical section through one of the ram guides along line F-F in FIG. 3 and FIG. 5*b;*
Figure 5B:
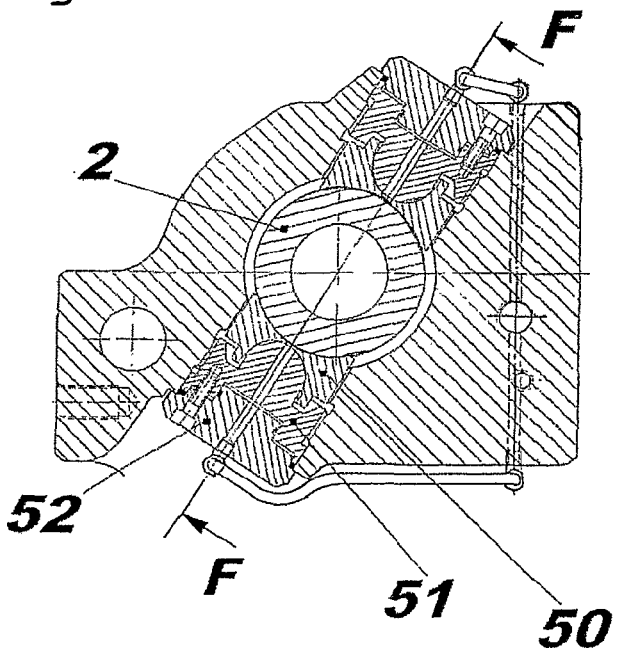
FIG. 5*b* a horizontal section through one of the ram guides along line G-G in FIG. 2 and FIG. 6.

As can be seen, the basic structure of the punching press consists of two machine housings 15, 15*b*, and one cross-member 15*a* with a clamping plate 23, which by means of screws 15*d* are interconnected with each other. Above the clamping plate 23 there is arranged a press ram 1, which is rigidly connected with four tension columns 2 that are in each case arranged at its outer corners. Every two of the tension columns 2 in each case are dedicated to one of the two machine housings 15, 15*b*, which in each case also contain the drive mechanism for the respective tension columns 2 which is described in the following, and are supported in a vertical displaceable manner in guides 3 in them, wherein the guides 3 are mounted in guide supports which at the same time form parts of the housing cover 4 of the respective machine housing 15, 15*b*. The guides 3, the configuration of which will be explained more into detail elsewhere by means of the FIGS. 5*a* and 5*b*, are inclination-tolerant and substantially momentum-free and are the sole guides 3 for the press ram 1. As can be seen, they are arranged in such a manner that the middle of their axial extent in longitudinal direction of the tension columns 2 lies exactly in the ideal or medial band movement plane X, respectively.

The two tension columns 2 which are dedicated to one common machine housing 15, 15*b* are, inside the machine housing 15, 15*b*, at their ends facing away from the ram 1 in each case rigidly connected with each other via a transverse yoke 5, which in turn with two lugs 6 is in articulated manner hinged to four levers 7 via bolts 6*a*.

The ends of these levers 7 which are facing away from the centre of the press are hinged by means of lugs 7*a* to spindle nuts 20, which for adjustment of the respective pivoting points can vertically be displaced by spindles 19. The drive of these spindles 19 is accomplished by worm wheels 18, which in each case together with a bearing unit 17 also serve for supporting the respective spindle 19. In order to avoid a turning of the spindle nut 20 upon a rotational movement of the spindle 19, the spindle nut 20 comprises an anti-twist device in the cover 20*a*.

The ends of the levers 7 which are facing the centre of the press are connected to two independent connecting rods 8 by means of a common connecting rod bolt. The upper ends of the connecting rods 8 in operation perform a stroke movement and are guided by means of sliding blocks 21 in linear guides 22 in such a manner that the connecting rod bolt can only perform a vertical movement.

In the lower, large bores of the connecting rods 8 there is arranged a common crank pin 9, 10 of a crankshaft 9, 10, 29 of the drive mechanism, which is formed by an eccentric 10 and an eccentric bushing 9. Through a turning of the eccentric bushing 9 relative to the eccentric 10 the resulting total eccentricity of the crank pin 9, 10 can be changed, which corresponds to a changed stroke of the crankshaft 9, 10, 29 and therewith also to a changed stroke of the punching press. In the present case, the punching press can be adjusted to a number of exactly defined strokes, in that different relative angle positions between the eccentric bushing 9 and the eccentric 10 can positively be locked by means of a locking bolt 32. The locking bolt 32 can be unlocked by means of an unlocking mechanism 31. Thereafter, the eccentric 10 can be turned relative to the eccentric bushing 9, while the eccentric bushing 9 is temporarily secured against turning by means of a latch 25 which can be inserted with a latch piston 26.

The crankshaft 9, 10, 29 consists of the two crank pins 9, 10 arranged in each case at its ends and of a hollow shaft 29 which interconnects the crank pins 9, 10 with each other and is protected with a cover 15*c*. It is supported with three floating bearings 30 and one fixed bearing 33 in the two machine housings 15, 15*b*. The unlocking mechanisms 31 are connected with each other via a coupling shaft 28 running in the centre of the hollow shaft 29 and by that can be commonly actuated from those side of the punching press which comprises the fixed bearing 33. On the other side of the punching press, the drive sub-assemblies 27 like brake, clutch and flywheel with the crankshaft 9, 10, 29 are arranged.

In order to realize a compensation of the masses in motion, to each bolt 6*a* the front end of a mass compensation lever 16 is hinged, in each case in addition to the lug 6. The centre of this lever 16 is supported in a rotatable manner in a bolt which is fix with the housing. The back end of the lever 16 is hinged to a counterweight 14 and drives same in operation in the direction opposite to the ram 1. The mass-forces in direction of the stroke are compensated in this way. Furthermore, pushing rods 11 are present, which are arranged at the bottom side of the respective connecting rod 8 and via levers 13 drive the counterweights 14 in the direction opposite to the connecting rod 8, for the compensation of the horizontal dynamic forces.

FIG. 3 shows a top view onto the punching press with the press ram 1 removed. The four tension columns 2 are depicted in section. As can be seen, for each tension column 2 there exists an adjusting gear 35 with a servo motor 34 for the adjustment and at best for the control of the position of the pivoting point of the respective lug 7*a*. The respective servo-gear-motor-unit 34, 35 for the adjustment drives, via a worm gear 16, the respective worm wheel 18, which is a fixed part of the threaded spindle 19. Through a corresponding adjustment of the pivoting points of the lugs 7*a*, a possible tilting of the ram 1, which under eccentric load of the press ram 1 amongst others is generated through different longitudinal expansions of the tension columns 2, can be compensated. Further details of these before described means for compensation of a longitudinal expansion due to load of the tension columns of the drive mechanism are shown in the left half of FIG. 4, which shows a horizontal section through one of the two machine housings 15, 15*b* of the punching press of the FIGS. 1 to 3.

Figure 4:
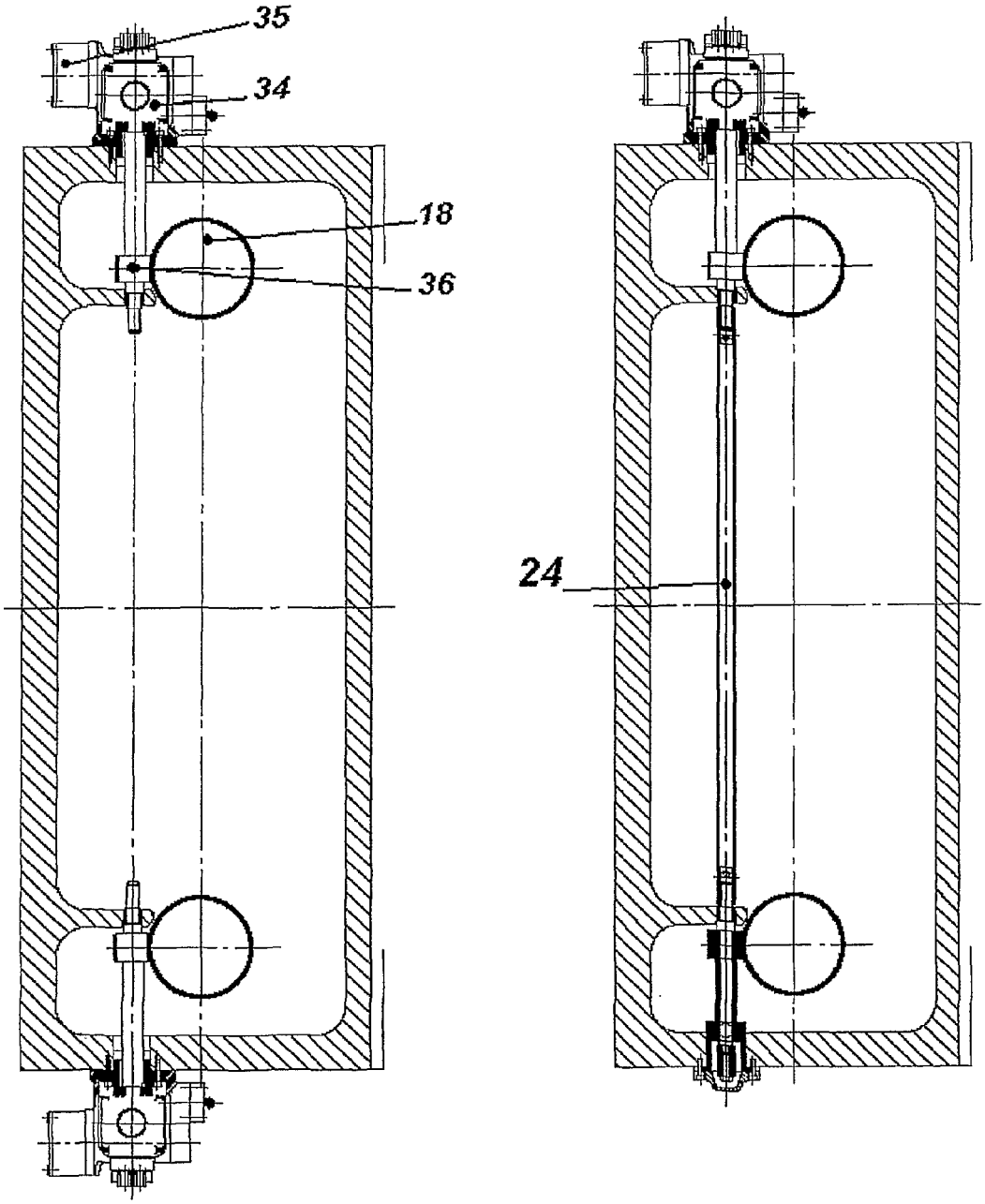
FIG. 4 two horizontal sections through one of the two machine housings of the punching press of the FIGS. 1 to 3 with different variants of spindle drives for the height adjustment of the ram.

In case only eccentric loads in longitudinal direction of the machine are expected, a variant with only one gear motor 34, 35 per machine housing 15, 15*b* is envisaged, as is depicted in the right half of FIG. 4. As can be seen, in this case, for the four tension columns 2 only two motor-gear-units 34, 35 are used, wherein in each case the worm gears 36 which are arranged in a common machine housing are in a rotatory manner connected by a hollow shaft 24.

Figure 6:
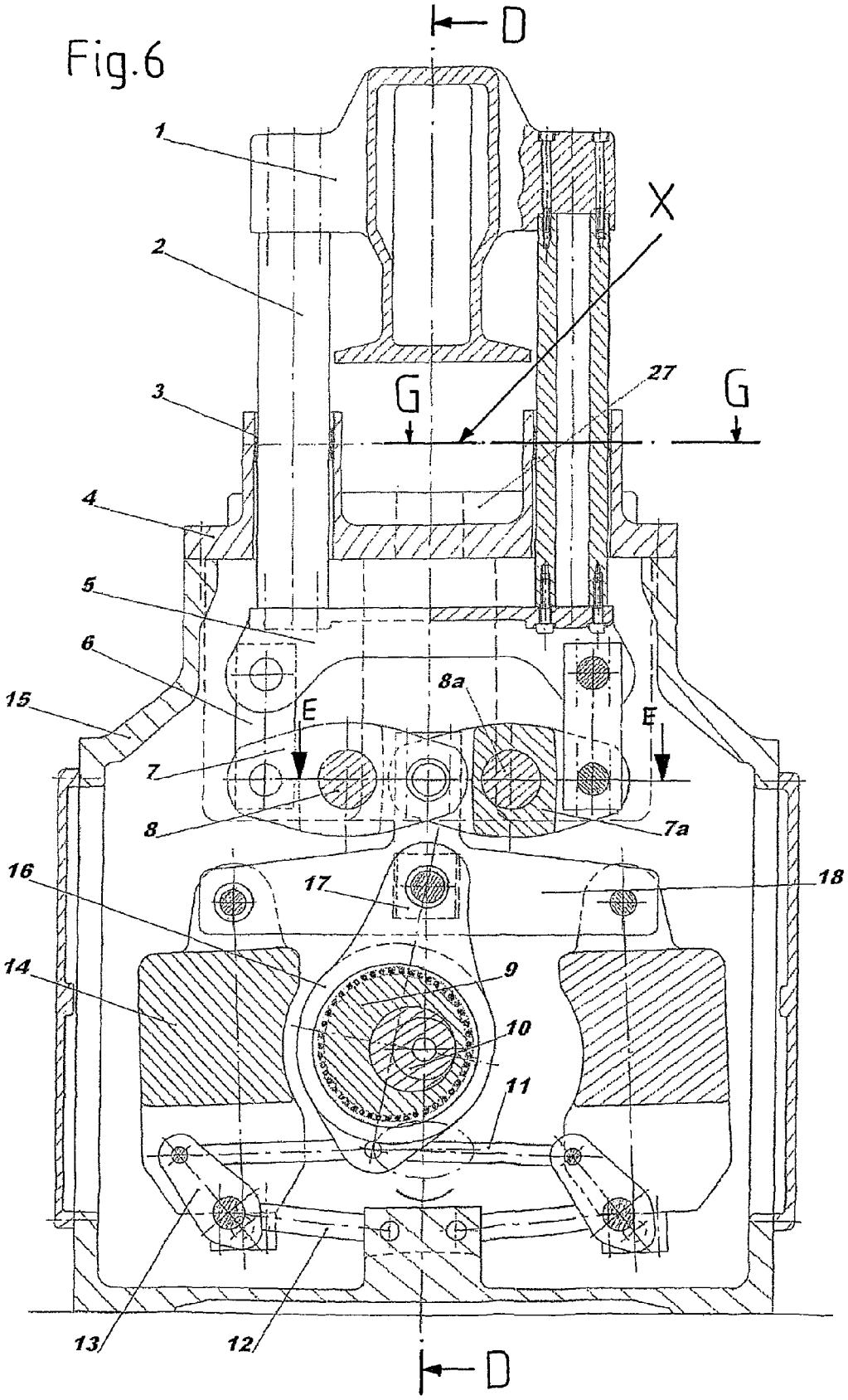
FIG. 6 a cross section through a second punching press according to the invention along line C-C in FIG. 7.

The FIGS. 5*a* and 5*b* show sections through one of the guide supports, wherein FIG. 5*a* shows a vertical partial section through the guide support along line F-F in FIG. 3 and FIG. 5*b*, respectively, and FIG. 5*b* shows a horizontal section along line G-G in FIG. 2 and FIG. 6, respectively. As can be seen, each of the four columns 2 is guided in the guide support from two sides by means of sliding blocks 50 through which an oil flow passes. From the side which lies opposite the tension column 2 this sliding block 50 has a hemispherical bore. A nut 51 with spheroidal end in each case serves for adjusting the play or for readjustment of same. Through the cover 52 on the one hand the lubricating oil is charged and on the other hand the adjusting nut 51 is secured. In this way the sliding blocks 50 can be adjusted with the nut 51 in said thread to or away from the column 2. By this, the advantage is arrived at that after many years of operation the play of these guides can be readjusted in a very easy way.

Figure 7:
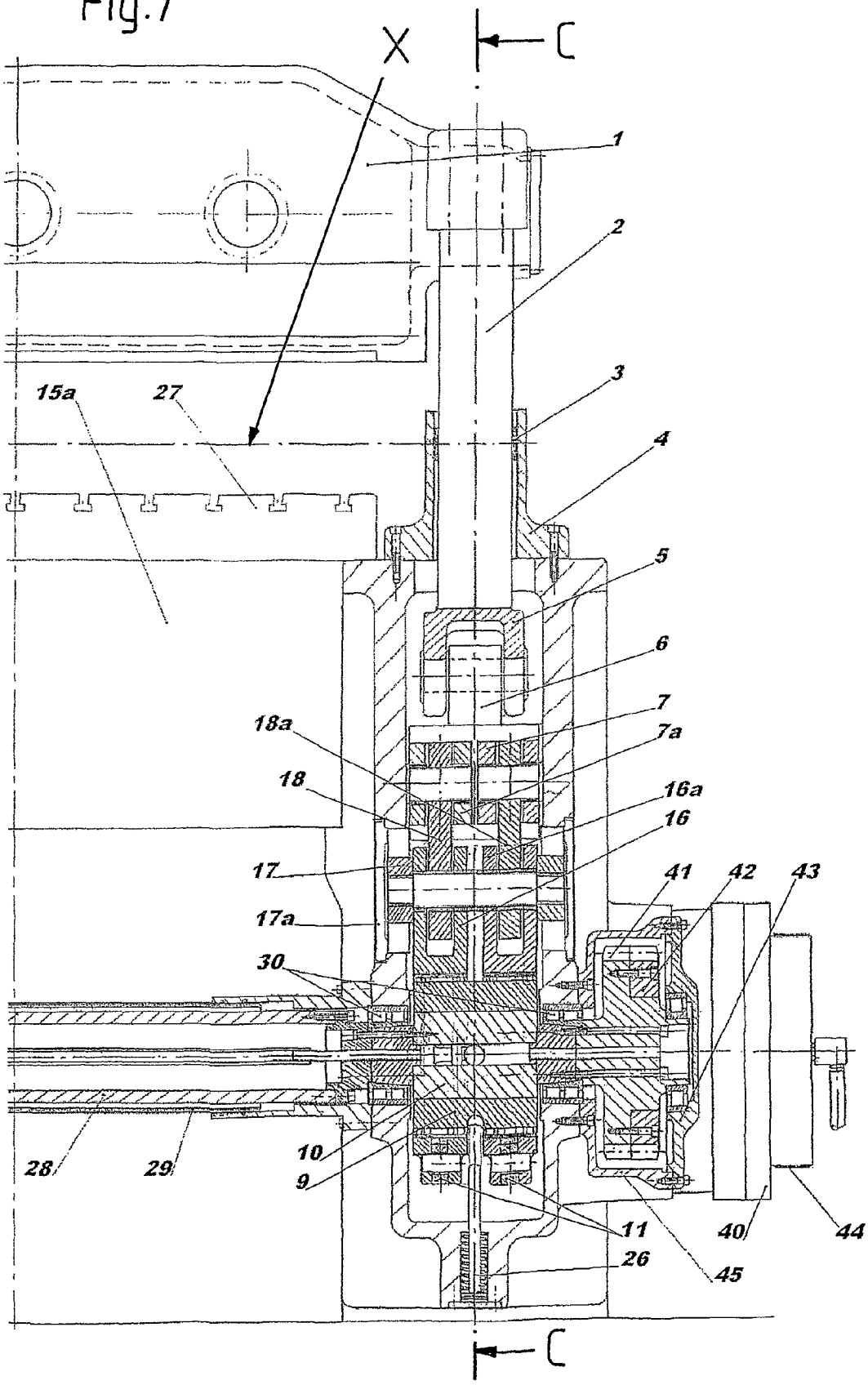
FIG. 7 a longitudinal section along line D-D in FIG. 6.
Figure 8:
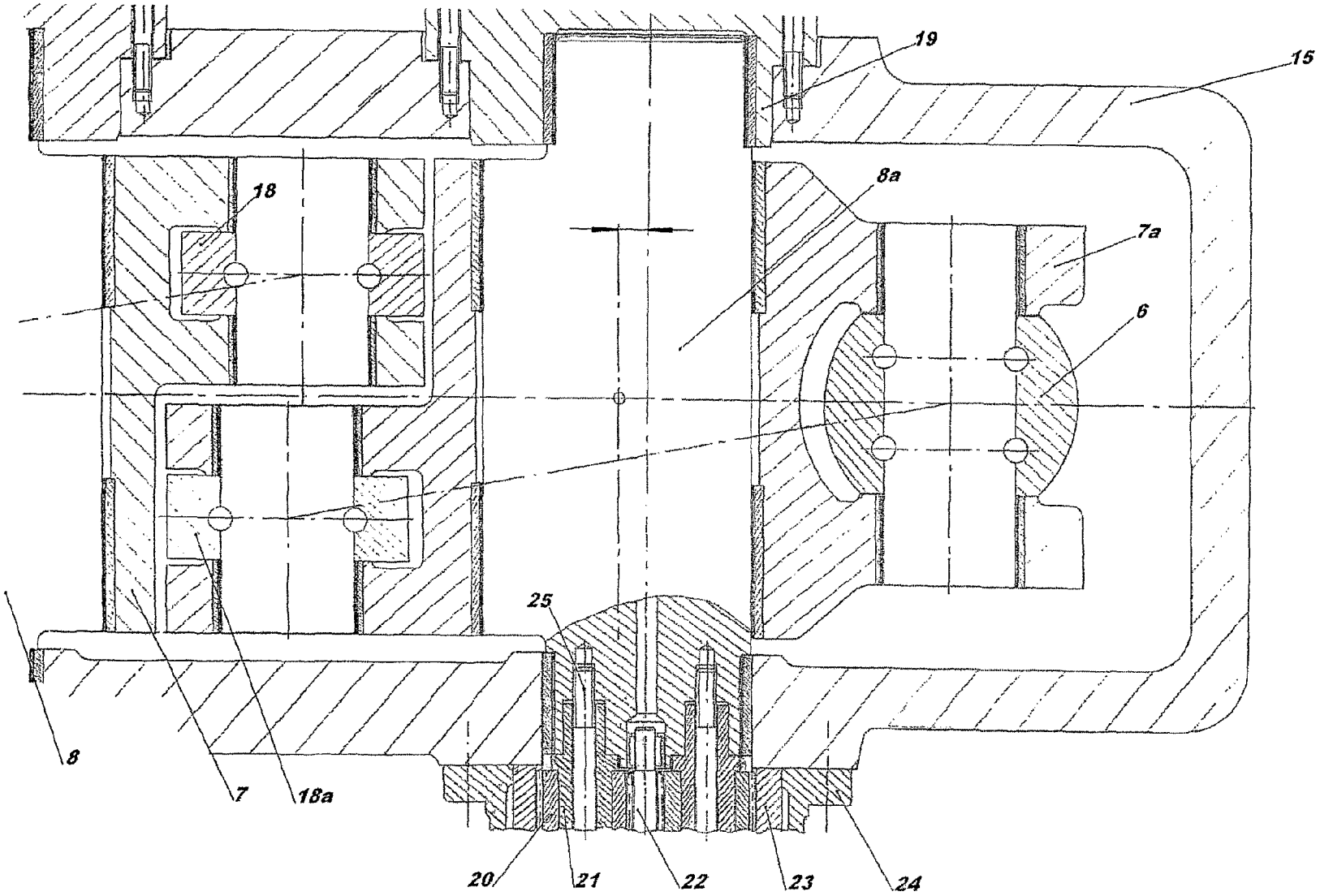
FIG. 8 a section along line E-E in FIG. 6.

The basic configuration of a second punching press according to the invention is apparent from the FIGS. 6 to 8, which show a section through the punching press (FIG. 6), a longitudinal section through one half of the punching press (FIG. 7) as well as a section through one half of the lever arrangement on one side of the press (FIG. 8).

As already in the punching press according to the invention shown in the FIGS. 1 to 4, the basic structure of the punching press consists of two machine housings 15 (only one machine housing is shown here) and of one cross-member 15*a* with a clamping plate 27, which by means of screws are connected with each other. Above the clamping plate 27 there is arranged a press ram 1, which is rigidly connected with four (only two are visible) tension columns 2 which in each case are arranged at its outer corners. Every two of the tension columns 2 in each case are dedicated to one of the two machine housings 15, which in each case also contain the drive mechanism for the respective tension columns 2 which is described in the following, and are supported in a vertical displaceable manner in guides 3 in them, which are identical to the guides used in the first exemplary embodiment and are shown into detail in the FIGS. 5*a* and 5*b*. As already in the before described exemplary embodiment, also here the guides are arranged in the respective machine housing 15 in the ideal or medial band movement plane X, respectively, likewise in that they are mounted into guide supports of the housing cover 4 of the respective machine housing 15.

Furthermore, also here the two tension columns 2 which are dedicated to a common machine housing 15 are, at their ends facing away from the ram 1, rigidly interconnected with each other via a yoke 5. Each yoke 5 is in turn, with lugs 6 via bolts, in a pivotable manner hinged to the ends facing away from the centre of the press of two levers 7, 7*a*, which levers in a mirror-inverted manner lie opposite to each other. The levers 7, 7*a* are in each case in the middle between their two ends with an eccentric shaft 8, 8*a* that is fix relative to the housing in a pivotable manner supported in the machine housing 15. The eccentric shafts 8, 8*a* can be pivoted in the housing 15 by means of actuators with planetary gears (in FIG. 8 partially shown), by means of which the position of the pivoting points of the levers 7, 7*a* at the structure can be changed.

The ends of these levers 7, 7*a* which are facing the centre of the press are in each case via a bolt connected in a pivotable manner with a pushing lug 18, 18*a*, which in turn in each case via a common bolt is connected in a pivotable manner with the end of an independent connecting rod 16, 16*a*, which end is the end of the connecting rod that is remote to the crankshaft. The upper ends of the connecting rods 16 in operation perform a stroke movement and in each case are by means of sliding blocks 17 guided in linear guides 17*a* in such a manner that the common connecting rod bolt exclusively can perform a vertical movement.

In the lower, large bore of the connecting rod 16, 16*a* there is arranged a crank pin 9, 10 of the crankshaft 9, 10, 28 of the drive mechanism which is common for both connecting rods, which crank pin is formed by an eccentric 10 and an eccentric bushing 9. The construction and the bearing situation of the crankshaft 9, 10, 28 are identical to the first exemplary embodiment according to the FIGS. 1 to 4 and therefore do not need to be described here again.

Since due to the eccentric shafts 8 which are fix with the housing the movements are turned at the ends of the levers 7, 7*a*, so that the pulling lugs 6 move upward when the pushing lugs 18, 18*a* move downward and vice versa, in this embodiment of the punching press according to the invention, due to the characteristics of the system a certain compensation of the moving masses takes place.

The rest of the compensation of moving masses is realized in that the outer ends of the pushing lugs 18, 18*a* in each case are hinged to the upper end of a compensation weight 14. By this, the mass forces in direction of the stroke are compensated. Furthermore, pushing rods 11 are present, which are arranged at the underside of the respective connecting rod 16, 16*a* and which drive, via levers 13, the counterweights 14 in the direction opposite to the connecting rod 16, 16*a*, for the compensation of the horizontal dynamic forces.

FIG. 8 shows a section through one half of a lever arrangement of one side of a punching press along line E-E in FIG. 6. As can be seen, the levers 7, 7*a* overlap in the centre of the press, where they are, in each case via bolts and the pushing lug 18, 18*a* dedicated to them, hinged to the end of the dedicated connecting rod 16, 16*a* which end is the end that is remote to the crankshaft. The ends of the levers 7, 7*a* which are facing away from the centre of the press in each case via bolts and the pulling lugs 6 dedicated to them are hinged to the transverse yoke 5 of the tension columns 2. In their centre, the levers 7, 7*a* are in each case supported in a pivotable manner on the eccentric shaft 8 dedicated to them, which at its both ends is supported in the housing 15. The eccentric shafts 8 in turn are in each case by means of an actuator with planetary gear 20, 21, 22, 23 pivotable around their bearing points, by mean of which the pivoting centre of the respective lever 7, 7*a* with respect to the housing 15 can be changed and with it the hinge point of the respective lever 7, 7*a* at the housing 15. As a consequence of this, the distance of the bottom edge of the ram 1 to the upper edge of the clamping plate 27 can be adjusted. For this reason it is possible to respond to different tooling heights, or there is the possibility to correct the position of the lower dead centre of the ram 1. Also it is possible by this to correct a tilting of the ram 1 under eccentric load.

The invention claimed is:

1. Punching press comprising:

a clamping plate, a press ram, four tension columns guided by inclination-tolerant guides, and a drive mechanism, wherein the press ram is disposed opposite an upper side of the clamping plate and is movable towards and away from the clamping plate by up and down movement via the four tension columns, wherein the drive mechanism is disposed below a band movement plane of the punching press and drives said up and down movement of the press ram, wherein the press ram is guided in said up and down movement exclusively via the tension columns, wherein the inclination-tolerant guides are configured to allow inclination of the tension columns about axes of inclination in a region of the band movement plane when the press ram is under an eccentric load.

2. Punching press according to claim 1, wherein the inclination-tolerant guides are substantially momentum-free, and the tension columns are guided exclusively in the region of the band movement plane in said inclination-tolerant guides.

3. Punching press according to claim 1, wherein the four tension columns comprise two pairs of tension columns with the tension columns in each of the pairs being disposed opposite to each other and being fixedly connected with each other via a connecting element.

4. Punching press according to claim 1, wherein the punching press comprises exactly four tension columns arranged in outer corners of the ram.

5. Punching press according to claim 3, wherein the tension columns in each of the pairs of tension columns are connected with each other via a yoke.

6. Punching press according to claim 1, wherein the drive mechanism comprises means for compensating for tilting of the press ram caused by a longitudinal expansion of the tension columns as a consequence of load.

7. Punching press according to claim 1, wherein the drive mechanism comprises at least one crankshaft with one or more connecting rods for transforming a rotatory drive movement into an intermittent upward and downward movement for driving the tension columns.

8. Punching press according to claim 7, wherein the crankshaft is disposed in longitudinal direction of the punching press.

9. Punching press according to claim 8, wherein the crankshaft is arranged centrally along a longitudinal axis of the punching press and forms a symmetrical arrangement with the tension columns.

10. Punching press according to claim 9, wherein the crankshaft comprises exactly two crank pins, which are arranged in a region of an end of the crankshaft and are flanked by a radial bearing of the crankshaft.

11. Punching press according to claim 10, wherein each of the crank pins is flanked on two sides by a radial bearing of the crankshaft dedicated to this crank pin.

12. Punching press according to claim 10, wherein in the region of the crankshaft between the radial bearings the crankshaft is hollow.

13. Punching press according to claim 11, wherein the crankshaft has a hollow component which is separate from components forming the crank pins.

14. Punching press according to claim 7, wherein the crankshaft comprises a plurality of crank pins each of which is formed by an eccentric and an eccentric bushing arranged in a rotatable manner such that, by turning the eccentric bushing on the eccentric, a stroke of the crankshaft can be adjusted.

15. Punching press according to claim 14, wherein the eccentrics and the eccentric bushings of each of the crank pins are lockable with respect to each in desired positions by means of a locking bolt, whereby to allow for setting a stroke of the crankshaft.

16. Punching press according to claim 15, wherein the locking bolt can be unlocked via a central unlocking mechanism which extends through an interior space of a hollow part of the crankshaft.

17. Punching press according to claim 7, wherein the crankshaft is supported in radial bearings and wherein exactly one of the radial bearings of the crankshaft is a fixed bearing for carrying axial forces acting upon the crankshaft.

18. Punching press according to claim 7, wherein the crankshaft is supported in a plurality of radial bearings, which each of the radial bearings is dedicated to one of the crank pins, wherein at least one of the bearings dedicated to a crank pin is mounted in a separate housing part that is connected to a central housing part which carries or forms the clamping plate.

19. Punching press according to claim 7, wherein each of the connecting rods has an end that is remote to the crankshaft and is hinged to a first end of at least one lever, wherein the at least one lever has a second end directly or indirectly hinged to the punching press such that by rotating the crankshaft through the connecting rod, the at least one lever can be reciprocated around its second end, wherein the at least one lever is hinged to at least one of the tension columns in a region between its first and second ends such that the at least one of the tension columns can be moved upward and downward by reciprocating the at least one lever.

20. Punching press according to claim 19, wherein the at least one lever is hinged to the punching press at its second end via a lug.

21. Punching press according to claim 19, wherein the at least one lever is connected with the tension column in a region between its first and its second end via a lug.

22. Punching press according to claim 19, comprising a guide for vertically guiding ends of the respective connecting rods that are remote to the crankshaft such that a pivoting point of the at least one lever is movable exclusively in a vertical direction.

23. Punching press according to claim 22, wherein ends of the respective connecting rods that are remote to the crankshaft are hinged in a common pivoting point to first ends of two levers, wherein the two levers are disposed opposite to each other and, seen in a longitudinal direction of the crankshaft, are mirror-inverted.

24. Punching press according to claim 7, wherein and end of each of the connecting rods that is remote to the crankshaft is connected with a first end of at least one lever that is hinged to the punching press in such a manner that the at least one lever can be reciprocated around a pivoting point through the connection rod by rotating the crankshaft, wherein the at least one lever has a second end that is hinged to at least one of the tension columns in such a manner that the at least one of the tension columns can be moved upward and downward through reciprocating the at least one lever.

25. Punching press according to claim 24, wherein the at least one lever is directly hinged to the punching press in a region between its first and second ends.

26. Punching press according to claim 24, wherein the at least one lever is connected at its second end to the at least one of the tension columns via a lug.

27. Punching press according to claim 24, comprising a guide for vertically guiding ends of the respective connecting rods that are remote to the crankshaft such that they are moveable exclusively in vertical direction, and wherein the ends of the respective connecting rods that are remote to the crankshaft are connected with the first end of the at least one lever via a lug.

28. Punching press according to claim 27, wherein the ends of the respective connecting rods that are remote to the crankshaft are hinged via separate lugs to first ends of two levers, wherein the two levers are disposed opposite to each other and, seen in longitudinal direction of the crankshaft, are mirror inverted, which in particular seen in a longitudinal direction of the crankshaft are mirror-inverted.

29. Punching press according to claim 28, wherein the two levers are dedicated to one of the tension columns and are fixedly connected with each other via a yoke.

30. Punching press according to claim 6, wherein the means for compensating enables adjustment of a vertical position of a pivoting point of at least one lever during operation of the press.

31. Punching press according to claim 30, wherein the position of the pivoting point of the at least one lever is adjustable by means of a threaded spindle with the aid of an actuator driving the threaded spindle.

32. Punching press according to claim 30, wherein the position of the pivoting point of the at least one lever is adjustable by means of an eccentric which is rotatable by an actuator which comprises a planetary gear.

33. Punching press according to claim 30, comprising a plurality of levers each of which is dedicated to one of the tension columns for the upward and downward movement of the respective tension columns through reciprocating of the dedicated lever around its pivoting point, wherein the respective positions of pivoting points of the levers can be adjusted in groups or independently from each other.

* * * * *